United States Patent [19]

Christoffel, Jr.

[11] 4,026,504

[45] May 31, 1977

[54] MANEUVERABLE, INFLATABLE KITE

[76] Inventor: Julius M. Christoffel, Jr., 5323 Yarwell, Houston, Tex. 77035

[22] Filed: Feb. 9, 1976

[21] Appl. No.: 656,156

[52] U.S. Cl. ..... 244/155 A; 244/153 R

[51] Int. Cl.[2] ..... B64C 31/06

[58] Field of Search ..... 244/155 R, 155 A, 153 R, 244/153 A, 154; D15/34 F

[56] References Cited

UNITED STATES PATENTS

| | | | |
|---|---|---|---|
| 2,733,880 | 2/1956 | Burrell et al. | 244/153 R |
| 2,839,259 | 6/1958 | Mayne | 244/155 A |
| 3,317,165 | 5/1967 | Zobl | 244/155 R |
| 3,746,286 | 7/1973 | Christoffel | 244/155 A |
| 3,952,975 | 4/1976 | Laske | 244/153 R |
| D231,245 | 4/1974 | Christoffel | 244/153 R X |

*Primary Examiner*—Trygve M. Blix
*Assistant Examiner*—Barry L. Kelmachter
*Attorney, Agent, or Firm*—Bard, Springs, Jackson & Groves

[57] ABSTRACT

A maneuverable, deltoid-shaped, inflatable kite having, when inflated, a bulbous nose portion, a central air beam, two diverging side air beams and an uninflated airfoil between the central air beams and each side air beam. Three control line anchors, one on the central air beam approximate the flying point and one on each of the side air beams; a control bar; control lines extending from each control line anchor to the control bar; and two maneuvering strings extending in a parallel path from the control bar to the kite flyer provide means for maneuvering the kite.

6 Claims, 5 Drawing Figures

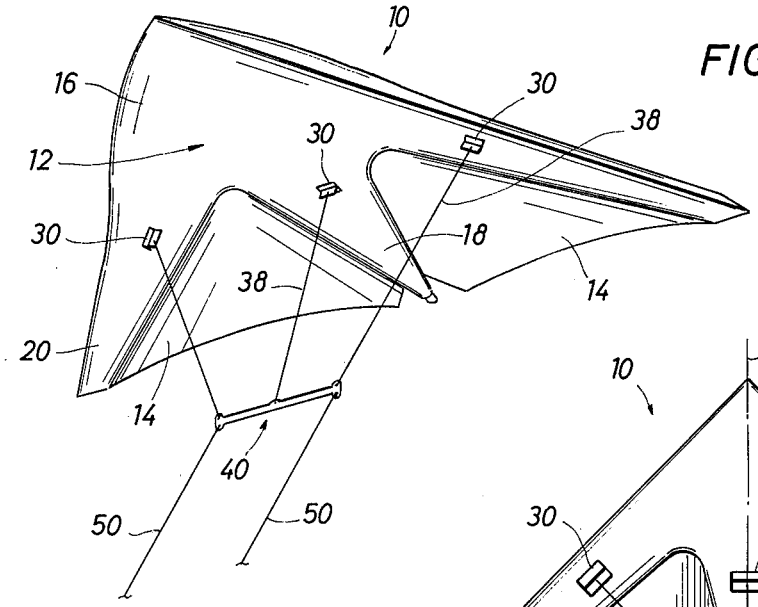
FIG. 1
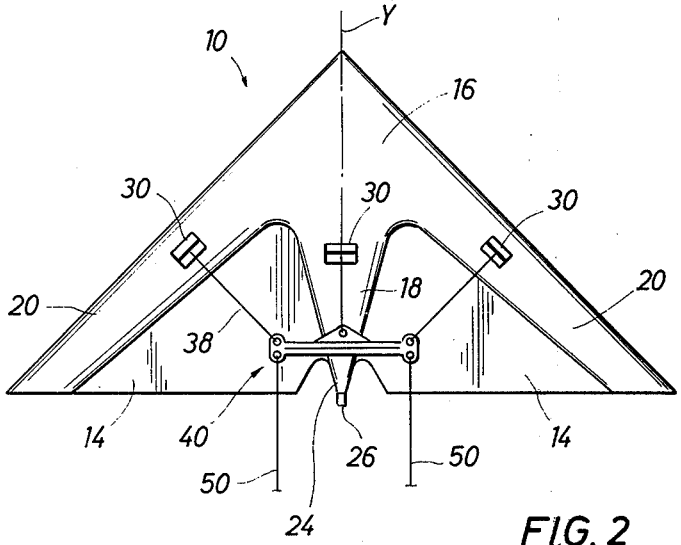
FIG. 2
FIG. 5
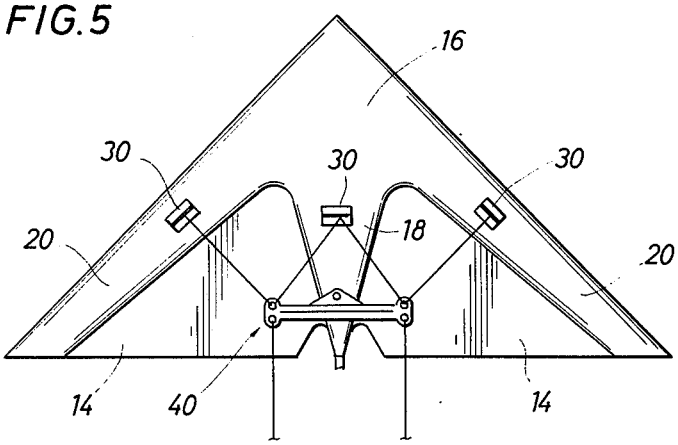
FIG. 3
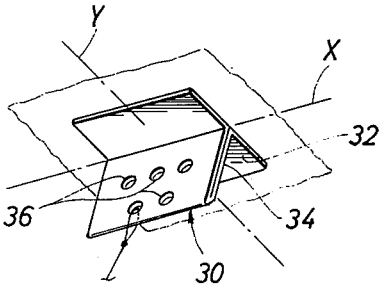
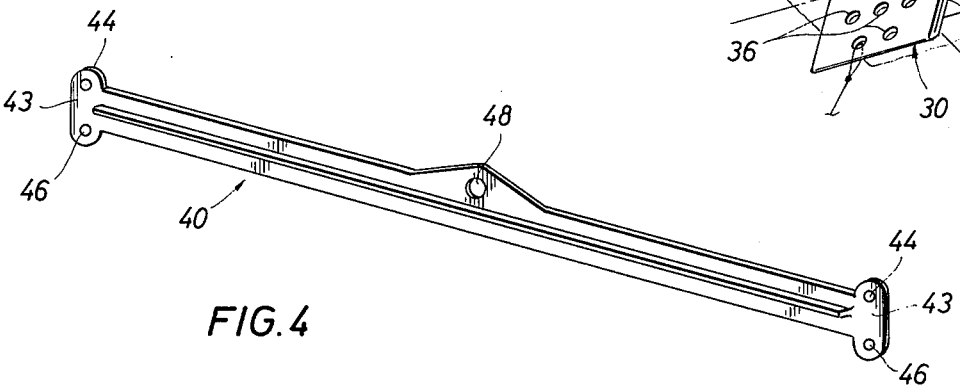
FIG. 4

MANEUVERABLE, INFLATABLE KITE

BACKGROUND OF THE INVENTION

1. Field of the Invention

The present invention relates to an improved inflatable kite which may be controlled by the flyer to perform acrobatic maneuvers.

2. Brief Description of the Prior Art

An improved novel, inflatable kite is disclosed in my copending application Ser. No. 631,534. The kite has, when inflated, a deltoid shape formed of a single air chamber and a pair of uninflated areas forming gull-wing airfoils. The air chamber has a bulbous nose portion from which three air beams extend, a central beam and two diverging side beams. The gull-wing airfoils extend inward from the rear, one between the central beam and each of the side beams. The kite has a single tethering string attaching means which is located on the central beam approximate the flying point. The kite, being inflatable, is easy to assemble for flight. By virtue of the single air chamber and the uninflated areas between the central air beam and side air beams, the inflated kite has structural integrity which allows it to be flown in most normal wind conditions. By having the tethering string attached at the flying point, the kite responds as an airfoil and has a high angle of flight. However, having a single tethering string, the maneuverability of the kite is limited.

My U.S. Pat. No. 3,746,286 dated July 17, 1973 and entitled "Kite Structure" discloses a keel-type kite having maneuvering means. The kite includes a control rod which is connected with the kite in such a manner that the relative position of the keel to the kite body may be changed to cause movement of the kite during flight in a desired position. With such a kite, the flyer can perform various stunts and, therefore, extend his enjoyment. Due to the difficulty and expense of attaching control lines to an inflatable kite, there has been no known inflatable, maneuverable kite. Accordingly, the object of the present invention is to provide an inflatable kite having means through which the flyer can control the kite to perform various aerobatic maneuvers.

It is a further object to provide a maneuverable, inflatable kite which is easy to assemble, has excellent structural integrity and is stable in flight.

SUMMARY OF THE INVENTION

The maneuverable, inflatable kite is formed of two layers of light weight, gas impervious plastic joined together to establish, when inflated, a deltoid formed of a single inflatable chamber having a bulbous nose with three air beams extending therefrom. One air beam extends along the central axis, and the other two air beams form the sides of the deltoid. Between the central air beam and each of the side air beams is an uninflated portion. When the kite is in flight, such portions form a pair of gull-wing airfoils. In order that the kite may be controlled to perform aerobatic maneuvers, the kite is provided with a control mechanism formed of a pair of maneuvering strings, a control bar, control lines and three control line anchors. One anchor is attached to the central air beam approximate the flying point; the other two anchors are attached to the side air beams. Extending from each of the anchors to the control bar is a control line. The control bar receives the pair of maneuvering strings extending from the flyer.

The control mechanism not only provides for maneuverability but, by its bridling, also enhances the structual integrity of the kite.

BRIEF DESCRIPTION OF THE DRAWINGS

FIG. 1 is a perspective view of the kite of the present invention in flight;

FIG. 2 is a plan view of the underside of the kite shown in FIG. 1, uninflated;

FIG. 3 is an enlarged perspective view of a control line anchor;

FIG. 4 is an enlarged perspective view of the control bar;

FIG. 5 is a schematic view illustrating an alternative for rigging of the control mechanism.

DESCRIPTION OF THE PREFERRED EMBODIMENT

As can be seen in FIG. 1, kite 10, when inflated, has a generally deltoid shape formed of a single air chamber 12 and a pair of uninflated areas forming gull-wing airfoils 14. The air chamber has a bulbous nose portion 16 from which three air beams extend, a central beam 18 and two diverging side beams 20. The gull-wing airfoils 14 extend inward from the rear of the kite, one between central beam 18 and each of side beams 20. The configuration may be like that shown in U.S. Design Pat. Nos. D-231,112, D-231,113, D-231,114 or D-231,245.

The kite 10 may be formed of two layers of delta shaped, light-weight, gas impervious material such as polyethylene. The layers may be separate sheets or two layers of a tube. To form the kite, the two layers are joined together by electronic heat sealing along the sides and along triangular paths extending inward from the base to define central beam 18 and the two side beams 20. If the kite is formed from a tube, the rear ends of the side beams will naturally be joined together; otherwise the rear ends of the side air beams are sealed. The end of central air beam 18 is opened to provide inflation means 24. To provide easy inflation, a short tube 26 of plastic may be inserted into the open end of central air beam 18. After inflation, the end of central air beam 18 is folded over inflation tube 26 and a rubber band 28 then twisted over the assembly to maintain air in single chamber 12.

A control line anchor 30 is attached to the central beam at the flying point of the kite which is the point that establishes a good flying attitude such as seen in FIG. 1. For the inflatable kite shown in FIG. 1, the flying point is located along the central longitudinal axis of central air beam 18 at approximately 3/5 of the distance from the nose. For inflatable kites with a large bulbous nose such as those in the aforementioned Design Patents, the flying point will be aft of the midpoint of the central axis extending from the nose to the tail.

The control line anchor 30 may be formed of a length of reinforced pressure sensitive material such as "TYVEK." The material may be folded in half and the two ends spread out to form a T-shaped member having cross arms 32 and leg portion 34. The arms 32 are adhesively secured to the underside of the kite. The leg portion 34 is provided with at least one aperture 36 for receiving a flexible member such as control line 38.

A similar control line anchor is attached to each of side air beams 20. All three control line anchors 30 may be on a straight line parallel with the rear portion of the kite. As can be seen in FIG. 2, control line anchor 30 on central air beam 18 extends laterally while control line anhcors 30 on side air beams 20 extend along the axes of the beams. If desired, all anchors 30 may extend laterally or along the axes of the air beams. Attached to each of control line anchors 30 is a control line 38.

The control lines 38 are attached to a control bar 40 which may be an extruded plastic member having a ribbed cross section with flattened end portions 43 provided with upper apertures 44 and lower apertures 46. Aperture 48 is located midway on the upper rib. The control lines 38 are attached to apertures 44 and central aperture 48. Attached to lower apertures 46 are a pair of maneuvering strings 50 which extend in a parallel path to the kite flyer.

By pulling on one of the maneuvering strings, the control rod 40 will tilt. Such movement will be transmitted to the side air beam through control line 38, causing the kite to change attitude. The control rod 40 keeps the maneuvering strings 50 apart in a parallel path and prevents crossing.

With such construction the flyer may by controlling maneuvering strings 50 perform various acrobatic maneuvers such as controlled climbs, dives, burns and loops. With the kite being controllable, two kite flyers may maneuver their kites in mock combat.

The control mechanism not only permits controlling of the kite to perform various aerobatic stunts but also by the particular bridling of the control mechanism enhances the structural integrity, thereby permitting the kite to be flown in rather strong winds. On the other hand, since the kite may be precisely positioned in various attitudes to catch and contain whatever breeze is available, the kite may be flown in extremely low wind conditions.

If desired, the kite may be flown by a single tethering string attached to central aperture 48. A plurality of apertures 36 in leg portion 34 of anchor 30 permits trimming of the kite.

While the anchors 30 on the side air beams 20 may be aligned with anchor 30 on central air beam 18, the anchors on the side air beams 20 may be placed somewhat to the rear of the anchor on central air beam 18. Also, instead of extending control line 38 from central anchor 30 to central aperture 48 of control rod 40, central anchor 30 may be provided with two control lines, one attached to each end aperture 44 of control rod 40, see FIG. 5.

With the control mechanism, the kite is not only maneuverable but may also be controlled to take advantage of available breezes and, due to bridling, has enhanced structural integrity allowing the kite to be flown in high winds.

Although the invention has been illustrated and described in connection with a single specific embodiment, it is to be understood that the inventive concept is not limited to the specific structure shown. All forms of the invention embraced within the language of the following claims is within the spirit of the invention and should be so understood.

What is claimed is:

1. A maneuverable, inflatable kite, said kite having a single air chamber which, when inflated, is generally in the form of a deltoid having a bulbous nose portion, a central air beam and two diverging side air beams, the kite also having two uninflatable areas forming a pair of gull-wing airfoils, one of said airfoils extending between the central air beam and each of the side air beams; three control line anchors, each anchor formed of an elongated arm portion adhesively attached to the kite and a leg portion extending therefrom, the leg portion having at least one aperture, one of said control line anchors attached to the central air beam approximate the flying point of the kite, one of the other control line anchors attached to each of the side air beams, a control bar formed of an extruded plastic member having a longitudinally extending, ribbed cross section with flattened end portions, each flattened end portion having two apertures, one of said apertures being a control line aperture, the other of said apertures being a maneuvering line aperture, a third control line aperture in the ribbed cross section midway of the control line apertures in the flattened end portions, at least one control line extending from the control line anchors to the control line apertures in the control bar, and a maneuvering line attached to each maneuvering line aperture of the control bar whereby a parallel pair of maneuvering lines extend to a flyer.

2. The maneuverable, inflatable kite specified in claim 1 in which the control line anchors on the side air beams are located approximate a line extending perpendicular to the control axis and through the control line anchor on the central air beam.

3. The maneuverable, inflatable kite specified in claim 2 in which the arm portion of the central air beam control anchor extends laterally of the central axis and the arm portion of each control line anchor extends along an axis extending through each side beam on said side air beams.

4. The maneuverable, inflatable kite specified in claim 1 in which there is a control line from each control line anchor on the side air beams attached to the control line apertures of the flattened end portions of the control bar and a control line from the control line anchor on the central air beam attached to the third control line aperture of the control bar.

5. The maneuverable, inflatable kite specified in claim 1 in which there is a control line from each control line anchor on the side air beams attached to the control line aperture of the flattened end portions of the control bar and two control lines extend from the control line anchor on the central air beam, one control line attached to each of the control line apertures of the flattened end portions.

6. A control assembly for a maneuverable kite having a control bar, three control line anchors, control lines extending from the control line anchors to said control bar and a pair of parallel extending maneuvering lines extending from the control bar to a flyer, the control bar being formed of an extruded plastic member having a longitudinally extending, ribbed cross section with flattened end portions, each flattened end portion having two apertures, one of said apertures being a control line aperture and the other aperture being a maneuvering line aperture, a third control line aperture in the ribbed cross section midway of the control line apertures in the end portions, the control lines from the control line anchors attached to the control line apertures of the control bar, the maneuvering lines attached to the maneuvering line apertures of the control bar.

* * * * *